US006527218B1

(12) United States Patent
Cramer et al.

(10) Patent No.: US 6,527,218 B1
(45) Date of Patent: Mar. 4, 2003

(54) DEVICE FOR WINDING OF ROLLS AND WINDING PROCESS

(75) Inventors: Dirk Cramer, Duisburg (DE); Frank Schorzmann, Monheim (DE)

(73) Assignee: Voith Sulzer Papiertechnik Patent GmbH, Heidenheim (DE)

( * ) Notice: Subject to any disclaimer, the term of this patent is extended or adjusted under 35 U.S.C. 154(b) by 209 days.

(21) Appl. No.: 09/645,333

(22) Filed: Aug. 25, 2000

(30) Foreign Application Priority Data

Aug. 27, 1999 (DE) ..... 199 40 665

(51) Int. Cl.[7] ..... B65H 18/14

(52) U.S. Cl. ..... 242/530.1; 242/542.1; 242/530.3; 242/541.5; 242/541.6

(58) Field of Search ..... 242/530.1, 530.3, 242/530.4, 541.5, 541.6, 542, 542.1, 542.4, 547

(56) References Cited

U.S. PATENT DOCUMENTS

| | | | | |
|---|---|---|---|---|
| 3,837,593 A | * | 9/1974 | Dorfel | 242/541.5 |
| 4,095,755 A | * | 6/1978 | Snygg et al. | 242/541.6 |
| 5,161,747 A | | 11/1992 | Krämer | |
| 5,165,618 A | * | 11/1992 | Ruff | 242/530.4 |
| 5,248,107 A | | 9/1993 | Sumida et al. | |
| 5,785,271 A | * | 7/1998 | Leskinen et al. | 242/530.1 |
| 5,806,783 A | * | 9/1998 | Turunen | 242/530.1 |
| 5,853,139 A | * | 12/1998 | Hehner et al. | 242/530.1 |
| 5,908,171 A | * | 6/1999 | Raudaskoski | 242/530.1 |
| 5,971,314 A | * | 10/1999 | Essert | 242/530.3 |
| 6,149,098 A | | 11/2000 | Kuhn et al. | |
| 6,182,919 B1 | * | 2/2001 | Fisher et al. | 242/530.1 |
| 6,260,789 B1 | * | 7/2001 | Cramer | 242/530.3 |

FOREIGN PATENT DOCUMENTS

| | | |
|---|---|---|
| DE | 2365606 | 9/1975 |
| DE | 3941384 | 6/1991 |
| DE | 9201791 | 5/1992 |
| DE | 4116068 | 11/1992 |
| DE | 4134648 | 4/1993 |
| DE | 4407618 | 9/1995 |
| DE | 29507313 | 10/1996 |
| DE | 29613554 | 1/1998 |
| EP | 0502522 | 9/1992 |
| EP | 0829439 | 3/1998 |
| JP | 4341443 | 11/1992 |
| WO | 93/15009 | 8/1993 |

OTHER PUBLICATIONS

Patent Abstracts of Japan M–1397, (Apr., 1993), vol. 17 No. 196.

* cited by examiner

*Primary Examiner*—William A. Rivera
(74) *Attorney, Agent, or Firm*—Greeblum & Bernstein, P.L.C.

(57) ABSTRACT

Winding device and process for winding wound rolls. The winding device includes a pressure roll axially divided into separate sections and a winding arrangement. The pressure roll is arranged to be placed on the winding arrangement. A coupling device is arranged to axially couple the separate sections together, and a drive unit is arranged to commonly rotatably drive the axially coupled separate sections. The process includes axially coupling the separate sections of the pressure roll together with the coupling device, rotatably driving the axially coupled separate sections, and pressing, at a beginning of a winding procedure, the separate sections of the pressure roll against the wound rolls.

28 Claims, 3 Drawing Sheets

DEVICE FOR WINDING OF ROLLS AND WINDING PROCESS

CROSS-REFERENCE TO RELATED APPLICATIONS

The present application claims priority under 35 U.S.C. §119 of German Patent Application No. 199 40 665.0, filed on Aug. 27, 1999, the disclosure of which is expressly incorporated by reference herein in its entirety.

BACKGROUND OF THE INVENTION

1. Field of the Invention

The invention concerns a device for winding rolls with a pressure roll, divided axially into separate sections, that can be positioned on a roll arrangement. Further, the invention concerns a winding process for winding partial webs that were cut from a material web into material web wound rolls, in which a driven pressure roll bears onto the material web wound roll with a predetermined pressure.

The invention is described below using a material web, e.g., a paper web, however, it can also be utilized for all material webs that are processed similarly, e.g., wound.

2. Discussion of Background Information

Usually, paper webs are produced in widths larger than the ones used later by the processors. For instance, paper webs are produced in widths of about 8 or 10 m, though a printing plant requires widths of about 0.5 to 3.8 m. For this reason the paper web is cut into partial webs with the desired width in one of the last steps of the production process. The partial webs are then wound into material wound rolls with the winding of the partial webs that are cut from the same material web occurring simultaneously.

During the winding process, a progression of the winding tightness in the material web wound roll that decreases from the inside to the outside is desired. It is known for that purpose to load the material web wound roll at the beginning of the winding process with a pressure roll, i.e., to press it into a winding bed or against a contact roll. In a winding bed, the pressure roll has the additional purpose of preventing the material web wound roll, which is comparatively light at the beginning of the winding process, from coming out of the winding bed.

A pressure roll that is axially divided in separate segments, is known from DE 41 34 648 A1. This pressure roll does not contact the wound rolls, however, but touches a central contact roll. The pressure roll serves to press the material web against the driven contact roll in order to cause an interruption of the web tension

SUMMARY OF THE INVENTION

The present invention provides better control in a winding process.

The winding device of the above mentioned type includes sections that can be coupled in the axial direction by a coupling device and that have a common rotational drive.

Such a pressure roll makes it possible to apply an additional driving torque to the wound rolls as they form at the beginning of the winding process, and still keeps the cost of construction small. A separate drive is not necessary for every segment. One drive for all segments is sufficient, because the sections can be coupled in the axial direction. The rotational drive, therefore, moves several sections together. Additionally, this has the advantage that all material wound rolls are driven with the same circumferential speed so that the winding process occurs comparatively evenly for all winding wound rolls. Due to lateral profile variations, however, it is generally unavoidable, in the production of paper, that certain diameter variations occur at larger diameters. When such diameter variations are visible the wound rolls are already big enough that the rotational drive of the pressure roll is usually no longer necessary. Then the coupling can be disengaged and the drive turned off. The pressure roll then acts on the wound roll in question only through the contact pressure.

Here, it is advantageous when the sections are positioned on a carrier that is moveable relative to the winding arrangement, in which each section in the detached mode is moveable separately with respect to the carrier and is provided with a positioning drive. In this manner, the entire pressure roll can follow a diameter change in the wound rolls. As the diameter of the wound rolls increases, the carrier is moved, e.g., raised. When the predetermined diameter of the coil is reached, at which the drive of the pressure roll is no longer necessary, each section of the contact roll can be moved separately in relation to the relevant wound roll so that the section with the desired pressure can remain at the circumference of the wound roll. In this way, the fact is utilized that differences in the diameters of individual wound rolls is usually rather small. Therefore, even when the sections are moved separately in relation to the carrier, the carrier as a whole can still be moved in order to follow the overall growing diameter of the wound rolls.

Preferably, the contact roll is located above the winding bed, which is formed by at least two carrier rolls. The special advantage of the divided yet drivable pressure roll is evident in connection with such a dual-carrier roll winder. In such a dual-carrier roll winder, the wound rolls are wound essentially end to end. Only small distances, if any, remain between the separate wound rolls. With the divided pressure roll, the desired driving torque can still be introduced to the separate wound rolls and at the same time the pressure can be increased, while at larger diameters the separate wound rolls can be subjected to the necessary winding pressure even when their diameters differ.

Preferably, the rotational drive and the coupling device are connected to a control device that reacts to a diameter of the roll arrangement. The control device can determine the actual diameter of the coil, e.g., with the help of a sensor and then can disengage the coupling device and turn off the drive as a function of the diameter determined. The determination of the diameter can be made in a wide variety of ways, e.g., it can be actually measured and/or it can be calculated from the number of rotations of the wound rolls.

Preferably, at least a part of the rotational drive forms the coupling device. Thus, the rotational drive combines several functions. Therefore, it serves not only to drive the pressure roll but also to transmit equal torque to all the sections.

Here, it is especially preferred for the rotational drive to have a driven friction roll which is in frictional contact with all sections. When the friction roll is rotated all sections are rotated evenly, and they are also protected from rotation relative to one another by the frictional contact with the friction roll.

The sections are preferably positioned on pivoted levers that are acted upon by the positioning drive. This ensures relatively simple control of the motion of the sections of the pressure roll relative to the carrier. The positioning drive, which of course must be able to exert a certain amount of force, can, e.g., take the form on a piston-cylinder arrangement.

In an alternative design, provisions can be made to arrange the positioning drive inside of each section. This avoids external components and reduces the space needed. In this way, each section is preferably provided with an axially displaceable slider arrangement in which the slider arrangements can be operated from the end faces of the pressure roll. With the help of the slider arrangements, the separate sections can be engaged with each other. Here, in the simplest case bolts or comparable parts are shifted axially so that they form a fixed connection between neighboring sections in the direction of rotation. The activation from the end face of the pressure roll simplifies control.

Here, it is advantageous when a slider activation device is provided at a face end of the pressure roll that activates the slider arrangement of the neighboring sections in which the slider arrangements of the following sections are activated by the slider arrangements of the preceding section. The slider activation device can be formed, e.g., by a hydraulic piston-cylinder arrangement that creates the force with the help of hydraulic fluid to shift the first slider axially. This shifting motion of the first slider or the first slider arrangement not only causes locking between the slider activation arrangement and the subsequent section, but also simultaneously triggers an axial motion of the slider arrangement in that section which results in a locking of this section with the following one. This motion continues over the total axial length of the pressure roll.

The slider arrangements of neighboring sections are preferably provided with engagement structures on the working surface facing each other. A gear tooth, e.g., is an advantageous engagement structure. An alternative is a severely roughened surface on both slider arrangements. Both structures allow a locking of neighboring sections more or less independent of their position or at least in a large number of angular positions. The locking of neighboring sections by a coupling device can then be controlled very easily.

The slider arrangements are preferably provided with return springs. When the slider activation device is turned off the slider arrangements are automatically reset and thus loosen the locking between neighboring sections.

In the process of the invention, the pressure roll is divided in the axial direction in sections which, at the beginning of the winding process, are linked and driven together, and, after, a predetermined diameter of the material coil has been reached, the drive is stopped and the sections are disengaged.

As described above in connection with the device, it is possible at the beginning of the winding process to not only subject all the wound rolls evenly to a contact pressure but to simultaneously introduce an additional driving torque so that the control of the winding tightness or the curve of the winding tightness can be improved considerably. As the wound roll diameter increases, such sensitive control is no longer necessary so that driving of the pressure roll can be omitted from a predetermined wound roll diameter on.

It is preferred here, that when the predetermined diameter is reached sections that overlap two material web wound rolls are lifted off the wound roll. This reduces the risk of winding tightness at the end zones being too high or too low caused by different diameters of neighboring wound rolls.

The present invention is directed to a winding device for winding wound rolls. The winding device includes a pressure roll axially divided into separate sections and a winding arrangement. The pressure roll is arranged to be placed on the winding arrangement. A coupling device is arranged to axially couple the separate sections together, and a drive unit is arranged to commonly rotatably drive the axially coupled separate sections.

In accordance with a feature of the present invention, the winding arrangement can include a winding bed arranged to receive a plurality of axially arranged wound rolls. The pressure roll may be arranged to contact the plurality of axially arranged wound rolls.

According to another feature of the instant invention, a carrier can be further included. The separate sections may be pivotably coupled to the carrier. The separate sections can be coupled to the carrier to be pivotable relative to the winding arrangement. Further, a positioning device can be included. During a winding process, the positioning device may be arranged to separately move the separate sections relative to the carrier.

In accordance with the invention, the pressure roll may be positioned above a winding bed formed by at least two carrier rolls.

According to still another feature of the present invention, a control device may be coupled to the drive unit and to the coupling device. The control device can be arranged to react to a diameter of the wound rolls.

At least a part of the drive unit can form the coupling device. The drive unit may include a friction roll arranged to frictionally contact all of the separate sections.

According to a further feature of the invention, pivotable levers can be coupled to a positioning drive, and the pivotable levers can be coupled to the separate sections. The positioning drive can be arranged to separately move the separate sections.

A positioning drive may be arranged within each separate section. The positioning drive may be arranged to separately move the separate sections. Each separate section can include an axially displaceable slider device, and the slider devices may be actuatable from an end face of the pressure roll. A slider actuation device may be positioned at the end face of the pressure roll and may be arranged to actuate the slider device of an adjacent separate section. The slider device of each section can be actuated by the slider device in an adjacent separate section. Further, the slider devices of the adjacent separate sections can include engagement structures on the working surfaces arranged to face each other. Still further, the slider devices can include reset springs.

The present invention is directed to a winding process for winding wound rolls from partial webs cut from a material web in an apparatus that includes a pressure roll axially divided into separate sections, coupling device arranged to axially couple the separate sections together, and a drive unit arranged to commonly rotatably drive the axially coupled separate sections. The process includes axially coupling the separate sections of the pressure roll together with the coupling device, rotatably driving the axially coupled separate sections, and pressing, at a beginning of a winding procedure, the separate sections of the pressure roll against the wound rolls.

According to a feature of the present invention, the separate sections may be pressed against the wound rolls with a predetermined force preferably ranging from 2 to 4 KN/m.

After a predetermined diameter for wound rolls is attained, the process can further include stopping the rotatable driving of the axially coupled separate sections. Moreover, after the predetermined diameter for the wound rolls is attained, the process can include disengaging the axial coupling of the separate sections. Further, after the axial coupling of the separate sections have been disengaged, each separate section which is arranged over adjacent wound rolls can be lifted off the adjacent wound rolls.

In accordance with another feature of the invention, after the predetermined diameter for the wound rolls is attained, each separate section which is arranged over adjacent wound rolls can be lifted off the adjacent wound rolls.

After a predetermined diameter for the wound rolls is attained, the process can include disengaging the axial coupling of the separate sections. After the axial coupling of the separate sections is disengaged, the separate sections may be pivoted toward the wound rolls. Further, after the axial coupling of the separate sections is disengaged, outer jackets of the separate sections may be radially outwardly pressed toward the wound rolls. Moreover, the separate sections can include radial actuating devices for radially moving the outer jackets.

According to still another feature of the instant invention, the axial coupling of the separate sections may include pressing the separate sections against a friction roll, and the friction roll can be rotatably driven to frictionally drive the separate sections pressed against the friction roll.

In accordance with yet another feature of the present invention, the axial coupling of the separate sections can include axially moving drive rings from one of the separate sections to an adjacent separate section.

Other exemplary embodiments and advantages of the present invention may be ascertained by reviewing the present disclosure and the accompanying drawing.

BRIEF DESCRIPTION OF THE DRAWINGS

The present invention is further described in the detailed description which follows, in reference to the noted plurality of drawings by way of non-limiting examples of exemplary embodiments of the present invention, in which like reference numerals represent similar parts throughout the several views of the drawings, and wherein.

DETAILED DESCRIPTION OF THE PRESENT INVENTION

The particulars shown herein are by way of example and for purposes of illustrative discussion of the embodiments of the present invention only and are presented in the cause of providing what is believed to be the most useful and readily understood description of the principles and conceptual aspects of the present invention. In this regard, no attempt is made to show structural details of the present invention in more detail than is necessary for the fundamental understanding of the present invention, the description taken with the drawings making apparent to those skilled in the art how the several forms of the present invention may be embodied in practice.

Figure 1B:
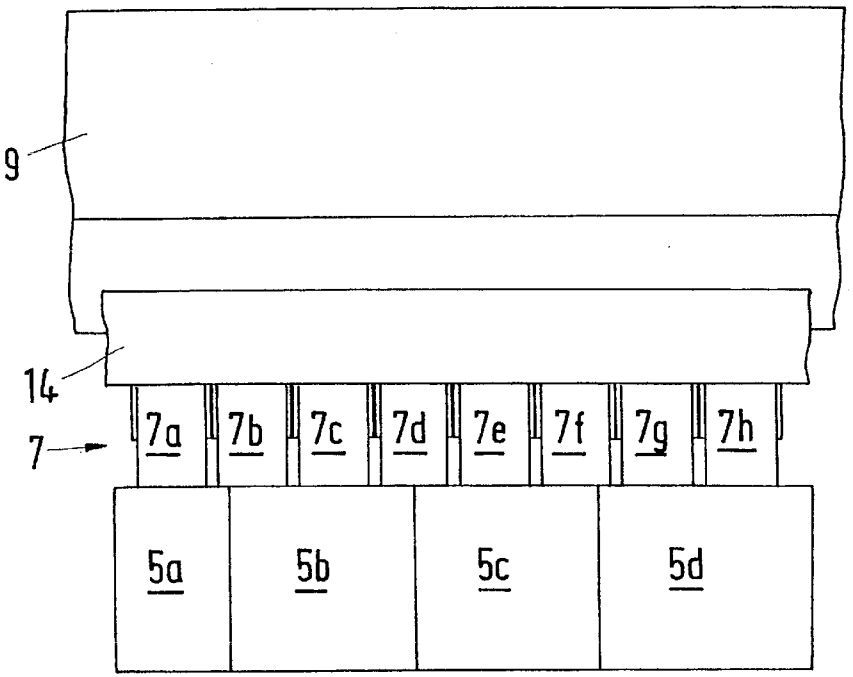
FIGS. 1*a* and 1*b* illustrate a first embodiment of the arrangement at the beginning of the winding process.
Figure 1A:
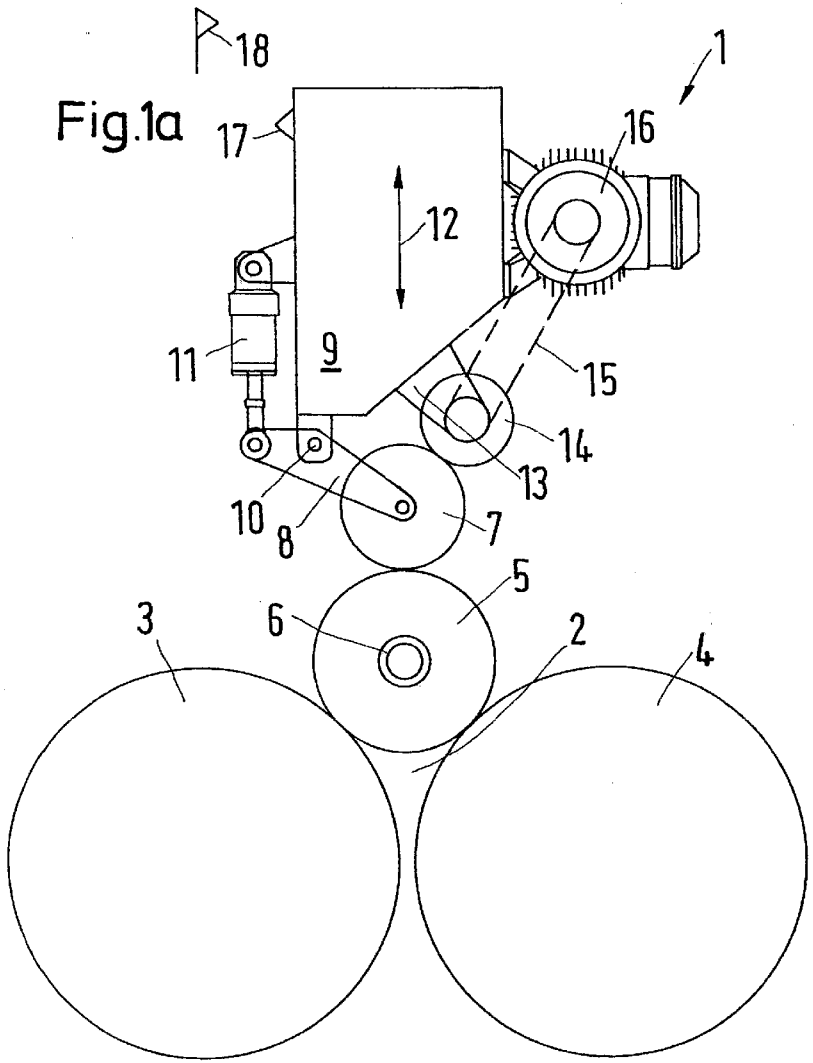

FIG. 1*a* illustrates a schematic side view and FIG. 1*b* illustrates a front view of a winding device 1. Winding device 1 is provided with a winding bed 2 which is formed by two carrier rolls 3 and 4. In winding bed 2, several wound rolls 5 are positioned side by side in the axial direction, designated as wound rolls 5*a*, 5*b*, 5*c*, and 5*d* in FIG. 1*b*. Rolls 5*a*–5*d* are rotatably driven by rotation of carrier rolls 3 and 4, and/or at least by rotatably driving one of carrier rolls 3 and 4. Thus, the material web (not shown in detail) is pulled onto rolls 5*a*–5*d* formed on roll cores 6, after having been cut into partial webs. Adjacent wound rolls 5*a*–5*d* are also called a winding arrangement.

A pressure roll 7 is arranged to sit on wound rolls 5*a*–5*d*. As shown in FIG. 1*b*, pressure roll 7 is axially divided into a plurality of sections 7*a*–7*h*. Each section 7*a*–7*h* is pivotably carried on levers 8, which are pivotably suspended on a carrier 9 around a pivot point 10. Levers 8 can be moved in relation to carrier 9 by a positioning drive 11, which can be, e.g., a piston-cylinder device, an electrical drive, a magnetic drive, etc.

Carrier 9 can be moved vertically in a direction of double arrow 12 with the aid of a lifting drive (not shown in detail), such that carrier 9 can be moved up and down relative to wound rolls 5.

On carrier 9, a retainer 13 for a friction roll 14 is provided, and friction roll 14 is connected to a rotational drive 16, e.g., an electric motor, via a chain 15 or a belt.

Positioning drive 11 of each section 7*a*–7*h* of pressure roll 7 is activated at a beginning of the winding process, as shown in FIGS. 1*a* and 1*b*, such that separate sections 7*a*–7*h* of pressure roll 7 are pressed against friction roll 14 with a force that produces a practically slip-free frictional engagement between friction roll 14 and sections 7*a*–7*h*. Carrier 9 is lowered far enough that pressure roll 7 contacts wound rolls 5 to press them into winding bed 2 with a certain, predeterminable and, if desired, adjustable force preferably ranging from 2 to 4 KN/m.

As a result of this mode of operation, wound rolls 5 can be wound with a comparatively high winding tightness at a beginning of the winding process, due to the comparatively high pressure and to the driving torque introduced by friction roll 14. Winding tightness can be reduced as the diameter grows by reducing the pressure and/or the driving torque by friction roll 14. With increasing diameter, carrier 9 is raised in the direction of arrow 12 so that pressure roll 7 always remains on or in contact with wound rolls 5.

As already mentioned above, friction roll 14 contacts sections 7*a*–7*h* such that a slip-free driving of sections 7*a*–7*h* is ensured. Thus, as all sections 7*a*–7*h* of pressure roll 7 are connected with each other in a non-rotating manner, only a single drive is necessary to drive all sections 7*a*–7*h* of pressure roll 7.

Figure 2B:
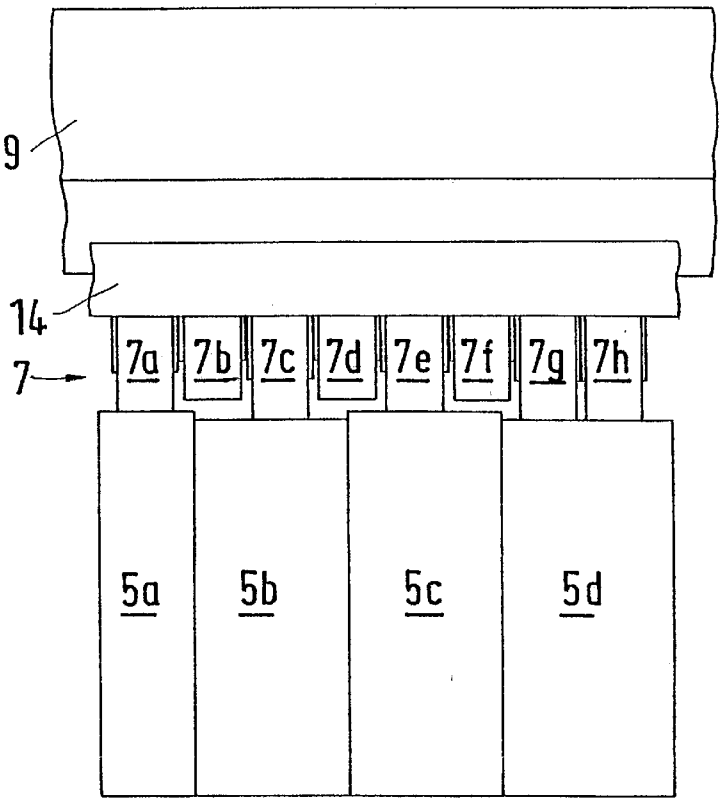
FIGS. 2*a* and 2*b* illustrate the arrangement in an advanced stage of the winding process.
Figure 2A:
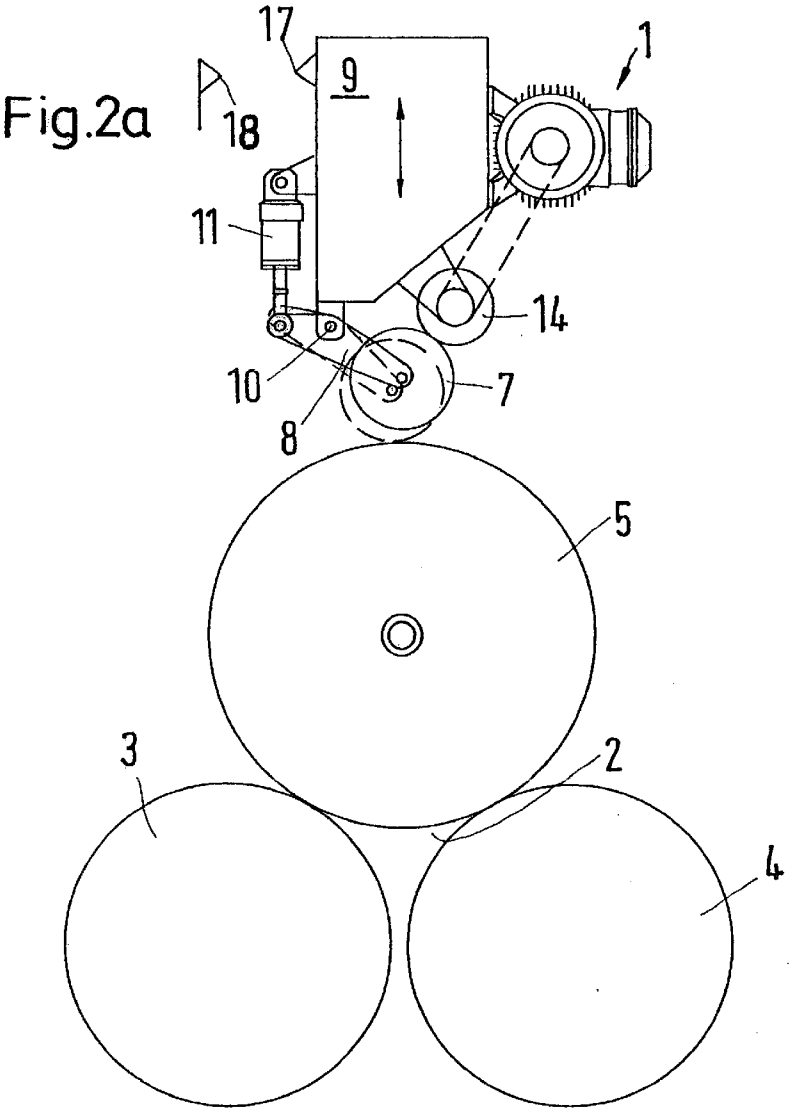

FIG. 2*a* depicts device 1 at a time at which the winding is further advanced, i.e., the diameter of wound rolls 5 has grown, and carrier 9 has traveled further upward. Carrier 9 is provided with a transmitter 17 for a sensor 18, and when transmitter 17 is positioned in alignment with sensor 18, e.g., as shown in FIG. 2*a*, wound rolls 5 have a diameter at which additional driving torque from pressure roll 7 is no longer necessary. As depicted in FIG. 2*b*, wound rolls 5*a*–5*d*, at this point, can have different diameters. It is noted that the differences shown in FIG. 2*b* are exaggerated for the purposes of illustration and explanation.

As soon as this desired diameter is reached, positioning drive 11 is activated and lever 8 is pivoted clockwise around pivot point 10, i.e., so that separate sections 7*a*–7*h* of pressure roll 7 are separated from friction roll 14 and, therefore, are no longer driven. Simultaneously, sections 7*a*–7*h* can be pressed against the circumferences of wound rolls 5 with a preferably in the range of 0 to 0.5 KN/m. force. In this context, the pivoting motion of lever 8H is synchronized with a raising motion of carrier 9.

When sections 7*a*–7*h* of pressure roll 7 are raised off of friction roll 14, the coupling between separate sections 7*a*–7*h* is released. At the same time, the driving of sections 7*a*–7*h* stops. Pressure roll 7, or its sections 7*a*–7*h*, only has the purpose of controlling winding tightness of wound rolls 5*a*–5*d* via contact. Here, the pressure exerted via pressure roll 7 can be further reduced as the winding process progresses, since the growing weight of wound rolls 5 leads to a corresponding increase in contact pressure on carrier rolls 3 and 4.

As shown in FIG. 2*b*, sections 7*b*, 7*d*, 7*f* of pressure roll 7 can be raised off wound rolls 5, since they would otherwise simultaneously contact and act on two separate wound rolls, i.e., 5*a* and 5*b*; 5*b* and 5*c*; and 5*c* and 5*d*, even though these wound rolls could have different diameters, as shown in the exemplary embodiment.

Figure 3B:
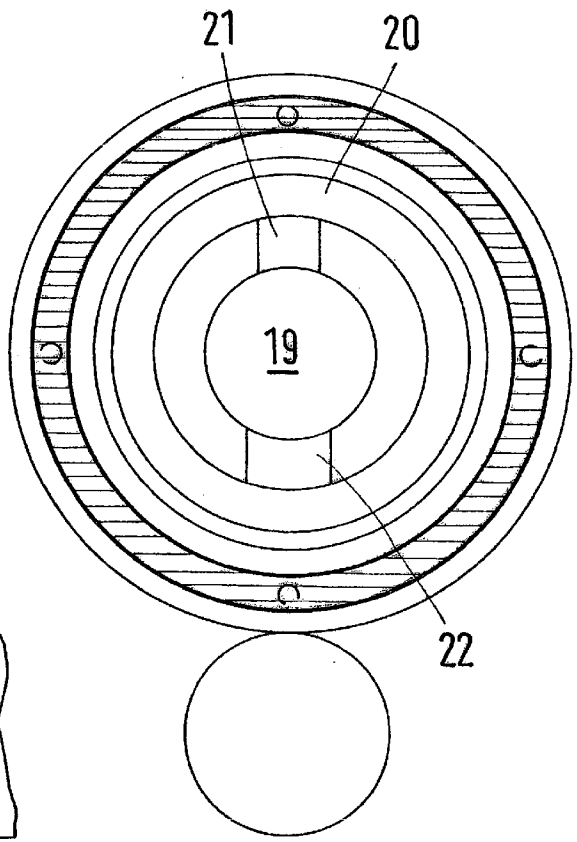
FIGS. 3*a* and 3*b* illustrate an alternative embodiment.
Figure 3A:
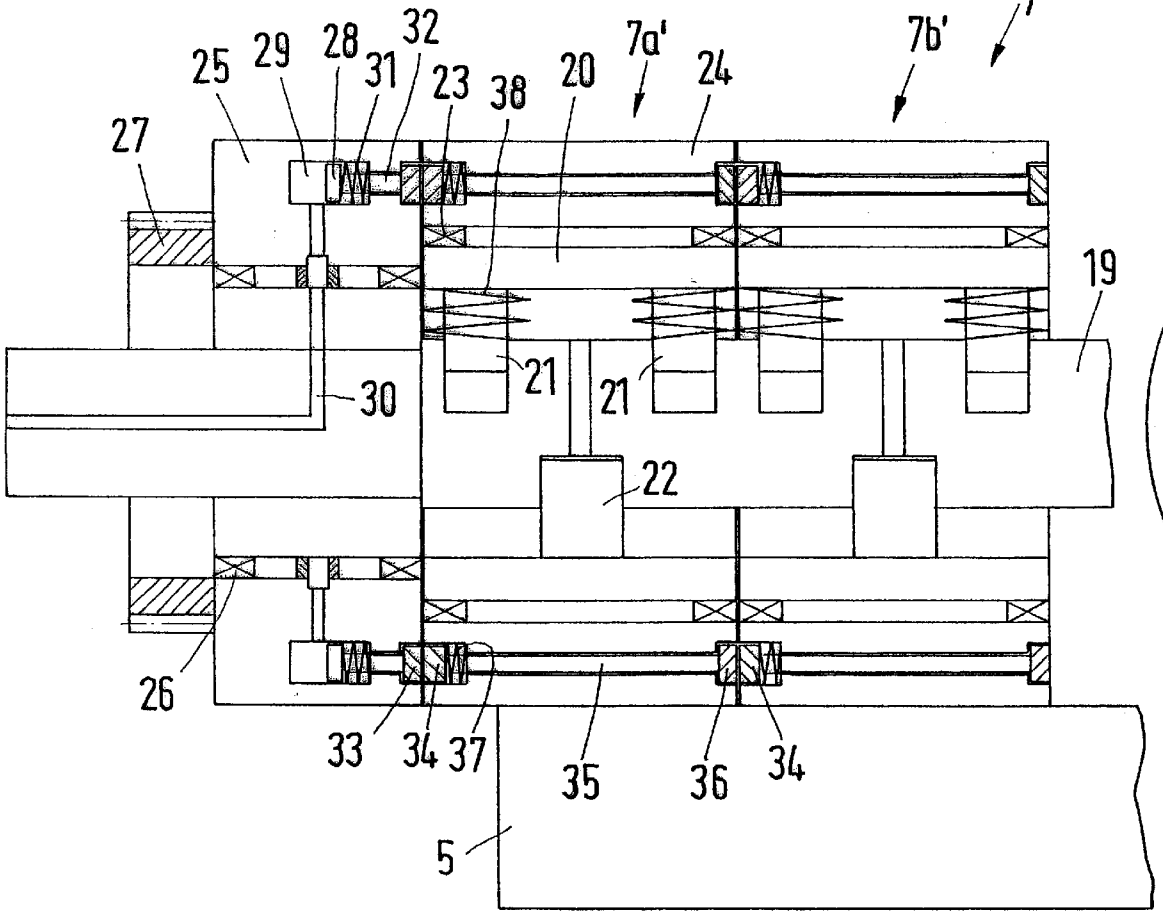

FIGS. 3*a* and 3*b* illustrates an alternative embodiment of a pressure roll 7'. In contrast to the embodiment depicted in FIGS. 1*a*, 1*b*, 2*a*, and 2*b*, in which the coupling device acts on pressure roll 7 "from the outside," in this embodiment, an "inner" contact device is provided.

Pressure roll 7' has an axles 19 which is surrounded by bearing rings 20. Axle 19 is mounted so as not to rotate. The bearing rings 20 can move up and down (see FIGS. 3*a* and 3*b*) via pistons 21 and 22, which are positioned in corresponding cylinders in axle 19, either toward or away from wound roll 5. Here, each section 7*a*' and 7*b*' includes its own bearing ring 20, and each bearing ring 20 can be raised or lowered individually.

Bearings 23 are positioned on top of bearing rings 20 to assist jackets 24 of individual sections 7*a*' and 7*b*' to rotate relative to bearing rings 20.

On an end face, e.g., shown on the left side in FIG. 3*a*, an end piece 25 is provided that is rotatably carried on axle 19 via bearings 26. The face of end piece 25 can be provided with a gear wheel 27, which can be driven by a motor (not depicted in detail).

In end piece 25, an annular piston 28 is provided which can be pressurized via a pressure chamber 29 with the pressure of a hydraulic fluid which is introduced via a line 30. Reset spring 31 is arranged to push annular piston 28 toward the left, i.e., toward gear wheel 27, when a pressure inside pressure chamber 29 drops.

Annular piston 28 can be connected via one or more actuating rods 32 to a clutch drive ring 33 that is pushed completely into end piece 25 during the unpressurized state of pressure chamber 29. Clutch drive ring 33 has on its end face (on the right in FIG. 3*a*) a gear (not described in detail).

In jacket 24 of section 7*a*', which adjoins end piece 25, a ring 34 is provided which is connected to a clutch drive ring 36 via several rods 35 that are evenly distributed in the circumferential direction and which corresponds to clutch drive ring 33. A reset spring 37 pushes rings 34 and 36 into their end position at the left side.

When separate sections 7*a*', 7*b*', etc., are to be connected with each other, i.e., during the beginning of the winding process, they are first brought toward each other in the axial direction and toward end piece 25, as depicted in FIG. 3*a*. When pressure chamber 29 is pressurized, annular piston 28 is pushed toward the right, such that clutch drive ring 33 engages ring 34, which causes the gear teeth of the two rings to interlock and form a torque transmitting coupling. Simultaneously, clutch drive ring 36 is pushed toward the right by rod 35 and forms a corresponding connection with ring 34 of following section 7*b*'. By this process, all sections 7*a*', 7*b*', etc., are coupled together non rotatably by pressurizing pressure chamber 29.

When the desired coil diameter is attained, the connection between the sections can be released and the position of jackets 24 of separate sections 7*a*', 7*b*', etc., can be adjusted by pistons 21 and 22. Since pistons 21 and 22 are pressure controlled, relatively simply measures can be used to subject all of wound rolls 5 to a same contact pressure.

It is noted that the foregoing examples have been provided merely for the purpose of explanation and are in no way to be construed as limiting of the present invention. While the present invention has been described with reference to an exemplary embodiment, it is understood that the words which have been used herein are words of description and illustration, rather than words of limitation. Changes may be made, within the purview of the appended claims, as presently stated and as amended, without departing from the scope and spirit of the present invention in its aspects. Although the present invention has been described herein with reference to particular means, materials and embodiments, the present invention is not intended to be limited to the particulars disclosed herein; rather, the present invention extends to all functionally equivalent structures, methods and uses, such as are within the scope of the appended claims.

What is claimed:

1. A winding device for winding wound rolls, the winding device comprising:

a pressure roll axially divided into separate sections;

a winding arrangement, wherein said pressure roll is arranged to be placed on said winding arrangement;

a coupling device arranged to selectively axially couple together selected separate sections; and a drive unit arranged to commonly rotatably drive said axially coupled separate sections.

2. The device in accordance with claim 1, wherein said winding arrangement comprises a winding bed arranged to receive a plurality of axially arranged wound rolls, wherein said pressure roll is arranged to contact said plurality of axially arranged wound rolls.

3. The device in accordance with claim 1, wherein said pressure roll is positioned above a winding bed formed by at least two carrier rolls.

4. The device in accordance with claim 1, further comprising a control device coupled to said drive unit and to said coupling device, wherein said control device is arranged to react to a diameter of the wound rolls.

5. The device in accordance with claim 1, wherein at least a part of said drive unit forms said coupling device.

6. A device for winding wound rolls, the winding device comprising:

a pressure roll axially divided into separate sections;

a winding arrangement, wherein said pressure roll is arranged to be placed on said winding arrangement;

a coupling device arranged to selectively axially couple together selected separate sections;

a drive unit arranged to commonly rotatably drive said axially coupled separate sections;

a carrier; and said separate sections being pivotably coupled to said carrier.

7. The device in accordance with claim 6, wherein said separate sections are coupled to said carrier to be pivotable relative to said winding arrangement.

8. The device in accordance with claim 6, further comprising a positioning device, wherein, during a winding process, said positioning device is arranged to separately move said separate sections relative to said carrier.

9. A device for winding wound rolls, the winding device comprising:

a pressure roll axially divided into separate sections;

a winding arrangement, wherein said pressure roll is arranged to be placed on said winding arrangement, a coupling device arranged to axially couple said separate sections together; and a drive unit arranged to commonly rotatably drive said axially coupled separate sections, wherein at least a part of said drive unit forms said coupling device and wherein said drive unit comprises a friction roll arranged to frictionally contact all of said separate sections.

10. A device for winding wound rolls, the winding device comprising:

a pressure roll axially divided into separate sections;

a winding arrangement, wherein said pressure roll is arranged to be placed on said winding arrangement;

a coupling device arranged to selectively axially couple together selected separate sections;

a drive unit arranged to commonly rotatably drive said axially coupled separate sections; and pivotable levers coupled to a positioning drive, said pivotable levers being coupled to said separate sections, wherein said positioning drive is arranged to separately move said separate sections.

11. A device for winding wound rolls, the winding device comprising:

a pressure roll axially divided into separate sections;

a winding arrangement, wherein said pressure roll is arranged to be placed on said winding arrangement;

a coupling device arranged to selectively axially couple together selected separate sections;

a drive unit arranged to commonly rotatably drive said axially coupled separate sections; and a positioning drive arranged within each separate section, wherein said positioning drive is arranged to separately move said separate sections.

12. The device in accordance with claim 11, wherein each separate section comprises an axially displaceable slider device, and said slider devices are actuatable from an end face of said pressure roll.

13. The device in accordance with claim 12, further comprising a slider actuation device positioned at the end face of said pressure roll and arranged to actuates said slider device of an adjacent separate section.

14. The device in accordance with claim 13, wherein said slider device of each section is actuated by said slider device in an adjacent separate section.

15. The device in accordance with claim 13, wherein said slider devices of said adjacent separate sections comprise engagement structures on the working surfaces arranged to face each other.

16. The device in accordance with claim 12, wherein said slider devices comprise reset springs.

17. A winding process for winding wound rolls from partial webs cut from a material web, in an apparatus that includes a pressure roll axially divided into separate sections, coupling device arranged to axially couple the separate sections together, and a drive unit arranged to commonly rotatably drive the axially coupled separate sections, said process comprising:

axially coupling the separate sections of the pressure roll together with the coupling device;

rotatably driving the axially coupled separate sections; and pressing, at a beginning of a winding procedure, the separate sections of the pressure roll against the wound rolls.

18. The process in accordance with claim 17, wherein the separate sections are pressed against the wound rolls with a predetermined pressure.

19. The process in accordance with claim 17, wherein, after a predetermined diameter for wound rolls is attained, the process further comprises stopping the rotatable driving of the axially coupled separate sections.

20. The process in accordance with claim 19, wherein, after the predetermined diameter for the wound rolls is attained, the process further comprises disengaging the axial coupling of the separate sections.

21. The process in accordance with claim 20, wherein, after the axial coupling of the separate sections have been disengaged, each separate section which is arranged over adjacent wound rolls is lifted off the adjacent wound rolls.

22. The process in accordance with claim 17, wherein, after the predetermined diameter for the wound rolls is attained, each separate section which is arranged over adjacent wound rolls is lifted off the adjacent wound rolls.

23. The process in accordance with claim 17, wherein, after a predetermined diameter for the wound rolls is attained, the process further comprises disengaging the axial coupling of the separate sections.

24. The process in accordance with claim 23, wherein, after the axial coupling of the separate sections is disengaged, the separate sections are pivoted toward the wound rolls.

25. The process in accordance with claim 23, wherein, after the axial coupling of the separate sections is disengaged, outer jackets of the separate sections are radially outwardly pressed toward the wound rolls.

26. The process in accordance with claim 25, wherein the separate sections include radial actuating devices for radially moving the outer jackets.

27. The process in accordance with claim 17, wherein the axial coupling of the separate sections comprises axially moving drive rings from one of the separate sections to an adjacent separate section.

28. A process for winding wound rolls from partial webs cut from a material web, in an apparatus that includes a pressure roll axially divided into separate sections, coupling device arranged to axially couple the separate sections together, and a drive unit arranged to commonly rotatably drive the axially coupled separate sections, said process comprising:

axially coupling the separate sections of the pressure roll together with the coupling device;

rotatably driving the axially coupled separate sections; and pressing, at a beginning of a winding procedure, the separate sections of the pressure roll against the wound rolls, wherein the axial coupling of the separate sections comprises pressing the separate sections against a friction roll, and wherein the friction roll is rotatably driven to frictionally drive the separate sections pressed against the friction roll.

* * * * *